United States Patent [19]

Martin

[11] 4,402,317

[45] Sep. 6, 1983

[54] SMOKE INHALATION SAFETY DEVICE

[76] Inventor: Roy E. Martin, 1202 W. Third, Lee's Summit, Mo. 64063

[21] Appl. No.: 281,025

[22] Filed: Jul. 6, 1981

[51] Int. Cl.[3] ..... A62B 7/00

[52] U.S. Cl. ..... 128/205.27; 128/206.19

[58] Field of Search ..... 128/205.27, 205.28, 128/205.29, 206.12, 206.16, 206.17, 206.19, 200.24, 202.13, 202.16, 202.17, 203.12, 203.18; 55/DIG. 24, DIG. 33, DIG. 35, 524, 387

[56] References Cited

U.S. PATENT DOCUMENTS 695,403 3/1902 Longden ..... 128/206.12

2,708,932 5/1955 Pipher ..... 128/206.16

3,284,361 11/1966 Rocchini et al. ..... 55/DIG. 24

FOREIGN PATENT DOCUMENTS 231281 1/1964 Austria ..... 128/202.13

*Primary Examiner*—Henry J. Recla

*Attorney, Agent, or Firm*—Schmidt, Johnson, Hovey & Williams

[57] ABSTRACT

A porous bag filled with relatively small, loose, oil coated wood chips permits sufficient air intake and adequately prevents smoke inhalation when placed over the nose and mouth while in most smoky atmospheres.

8 Claims, 5 Drawing Figures

SMOKE INHALATION SAFETY DEVICE

One of the major causes of death and injury during fires is smoke inhalation. Thus, there is a dire need for the inexpensive safety device embodying my present invention taking the form of a small, portable, air permeable pillow-like covering for the nose and mouth.

It includes a porous container of soft, flexible, oil absorbent material, e.g. a fabric, which envelops a dust free quantity of loose, relatively small chips or shavings, chosen from one or more aromatic woods, such as walnut or cedar.

The wood is lightly coated with an oily substance that is neither highly volatile nor readily combustible. The coating substance is selected from any one of the many vegetable oils which have a moderate viscosity and stickiness and bear the essence of the plant's fragrance.

Therefore, the device is light in weight, pleasant smelling, and adapted to be placed in use easily and quickly should the need arise. Sufficient air flows through the bag and its filler during natural breathing without substantial risk of asphyxiation inasmuch as intake of smoke into the lungs is adequately eliminated.

An elastic headband is provided to maintain the device in place, and a strong, impermeable case therefor retains excess oil drainage. The case has a closure which can be easily and rapidly opened during emergencies.

My attention has been called to the following U.S. Pat. Nos.:

| | | |
|---|---|---|
| 443,191 | Illing | December 23, 1890 |
| 533,854 | Loeb | February 5, 1895 |
| 904,287 | Warham | November 17, 1908 |
| 2,261,362 | Gill | November 4, 1941 |
| 2,865,466 | Frohmader | December 23, 1958 |
| 3,107,986 | Plaut, et al. | October 22, 1963 |
| 3,807,144 | Graybill | April 30, 1974 |

A pillow-like, metal free, protective device 10 may be of any desired size and shape although one having about a 10" by 10" peripheral dimension with approximately a 4' maximum thickness has been found to be quite satisfactory for the contemplated use thereof as hereinbelow to be fully explained.

Figure 1:
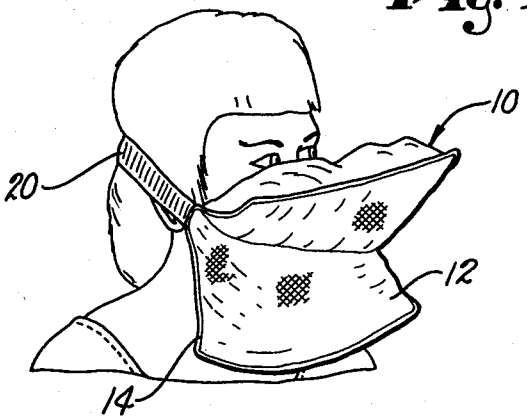
FIG. 1 is a perspective view of a smoke inhalation safety device made in accordance with my present invention shown in place over the mouth and nose of the user.
Figure 2:
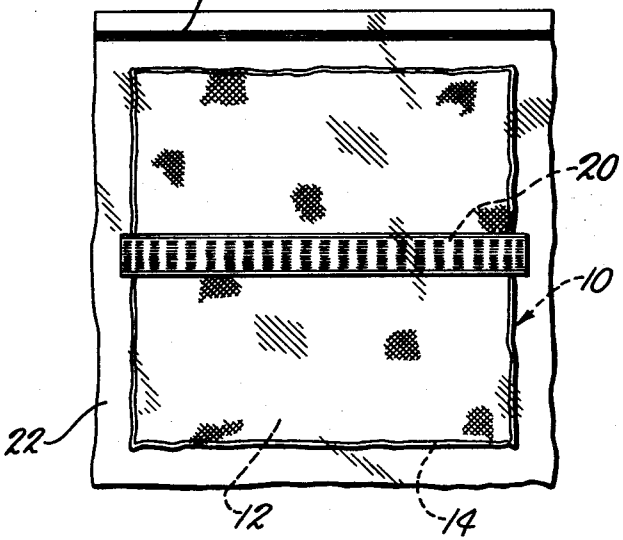
FIG. 2 is an enlarged, elevational view of the back of the device shown within a storage case.
Figure 3:
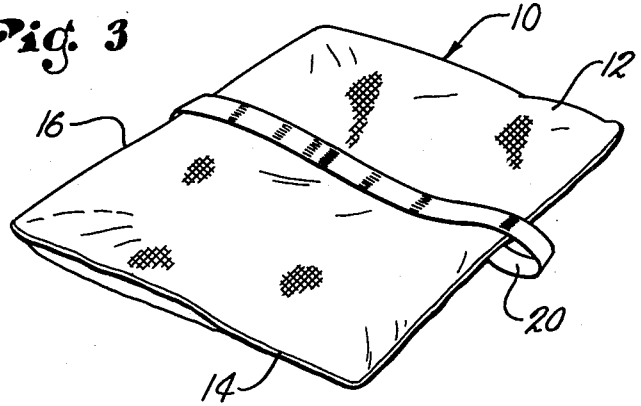
FIG. 3 is a rear perspective view of the device removed from its case.
Figure 4:
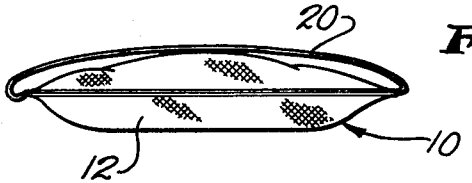
FIG. 4 is an edge view thereof.
Figure 5:
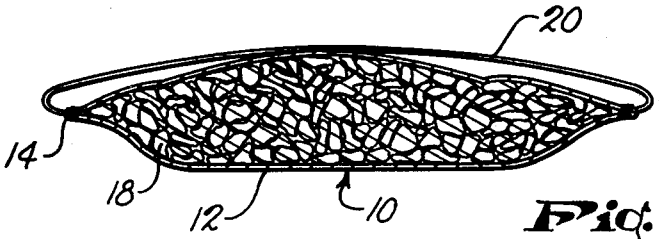
FIG. 5 is a cross-sectional view thereof still further enlarged.

The device 10 includes a container 12 which may be made from an oil absorptive cloth such as to be flexible, sufficiently permeable for flow of air therethrough and have a soft, smooth, delicate outer surface to thereby conform to the shape of the face and not be irritating to the skin when placed over the nose and mouth as shown in FIG. 1. The container 12 is fully closed as by marginal stitching 14 along its periphery except at a line of fold 16. The pores or interstices of the cloth for the container are desirably not more than 1/64" in size.

A filling 18 of relatively small, discrete fragments of barkless wood chips, shavings or the like is loosely enveloped in the container 12, care being taken to eliminate as much as possible any substantial amount of dust and other fine or pulverized particles. It is desirable that the filling 18 be chosen from the aromatic woods so as to be pleasant to the smell when the device 10 is placed in use. One of my preferred woods is cedar but walnut and a mixture of cedar and walnut are also acceptable substitutes. The wood fragments for the filling 18 may have a size ranging from about ¼" to ½" and a thickness of around 1/32" for best results.

To preclude drying of the wood fragments and to maintain dust (if any) within the container 12, they are coated with a substance which has an oily consistency. The oil should be agreeable to the senses and devoid of an unpleasant odor. To be avoided is the use of oils which might be irritating to the nostrils, throat, mouth and skin. Moreover, spraying of the oil onto the fragments in avoidance of an excess is preferred to saturation. The oiled fragments should then be well drained before filling into the porous bag-like container 12. Therefore, the oily substance to be used is preferably chosen from the industrial vegetable oils which bear the essence of the plant's fragrance and be moderately viscous and sticky, e.g. olive, soybean, cottonseed, peanut, coconut, sunflower, rapeseed and corn germ.

While the device 10 may be held by hand in the position shown in FIG. 1, both hands are freed by use of an elastic headband 20 having its ends secured to the container 12 by the stitching 14.

When not in use, the device 10 may be stored in an oil impermeable case 22 made, for instance, from plastic and having a releasable closure 24 along one marginal edge. Snap in types of tongue and groove closures 24, readily available on the open market, are quite satisfactory.

OPERATION

It is to be suggested that one or more of the devices 10 be kept readily accessible in every household wherever fire is likely to originate or spread, as in the basement, in the kitchen and adjacent each bedstead. Each hotel room, office, store and other public establishments might well provide the devices 10 as a precaution and safety measure. Any tendency for oil to leak beyond the container 12 might soil contents of travel bags were it not for the case 22, it certainly being one important recommendation that protection away from the home be kept in mind by owners of my devices 10.

When needed the device 10 is simply held in place or worn in the manner shown by FIG. 1. The user breathes quite naturally until able to exit the smoke filled atmosphere, all the while in freedom of inhalation of the smoke through the container 12 and the filling 18.

I claim:

1. A yieldable, metal free covering adapted to readily conform to the shape of the face when placed across the face against the nose and mouth and use while breathing therethrough in a smoky atmosphere to protect the respiratory system against undue smoke inhalation, said device comprising:

a closed, pillow-like bag of soft, flexible, air permeable material; and a filling of relatively small, discrete, substantially dust free fragments of loose, barkless, aromatic wood chips, shavings or the like pleasant to the smell and enveloped in said bag, said fragments being incapable of inhalation from the bag during said breathing and being lightly coated with a pleasantly fragrant substance having an oily consistency.

2. The invention of claim 1; and an elastic headband secured to the bag for holding the covering in place against the nose and mouth during use.

3. The invention of claim 1; and an oil impermeable case for said covering provided with a releasable closure.

4. The invention of claim 1, said substance being chosen from the vegetable oils bearing the essence of the plant's fragrance.

5. The invention of claim 1, said material having a soft, smooth, delicate outer surface.

6. The invention of claim 5, said material being an oil absorptive cloth.

7. The invention of claim 1, said fragments being chosen from the aromatic woods.

8. The invention of claim 7, said fragments being selected from the group which includes walnut and cedar.

* * * * *